US005736720A

United States Patent [19]

Bell et al.

[11] Patent Number: 5,736,720

[45] Date of Patent: Apr. 7, 1998

[54] LOADER MOUNTED PAINTBALL GAME SCOREKEEPER AND AN ASSOCIATED PAINTBALL GAME PLAYING SYSTEM

[75] Inventors: Roderick L. Bell; David W. Bell, both of Mesquite, Tex.

[73] Assignee: CM Support, Inc., Dallas, Tex.

[21] Appl. No.: 705,220

[22] Filed: Aug. 29, 1996

[51] Int. Cl.[6] ..... H01H 9/00; H01H 45/00

[52] U.S. Cl. ..... 235/1 B; 273/DIG. 26; 340/323 R

[58] Field of Search ..... 235/1 B; 273/DIG. 26; 340/323 R; 377/5

[56] References Cited

U.S. PATENT DOCUMENTS

| | | | |
|---|---|---|---|
| 2,838,238 | 6/1958 | Menes | 235/1 B |
| 4,089,318 | 5/1978 | Hesener | 235/1 B |
| 4,189,143 | 2/1980 | Van Auken et al. | 235/1 B |
| 4,220,992 | 9/1980 | Blood et al. | 364/410 |
| 5,084,695 | 1/1992 | Freeman | 340/323 R |
| 5,181,009 | 1/1993 | Perona | 273/DIG. 26 |
| 5,282,454 | 2/1994 | Bell et al. | 124/49 |
| 5,338,032 | 8/1994 | Latham | 340/323 R |
| 5,489,122 | 2/1996 | Pittner | 273/DIG. 26 |
| 5,559,490 | 9/1996 | McDonald et al. | 340/323 R |

*Primary Examiner*—Stuart N. Hecker

*Attorney, Agent, or Firm*—Haynes and Boone, L.L.P.

[57] ABSTRACT

A paintball game scorekeeper and an associated paintball game playing system. The paintball game scorekeeper includes a switch member having plural control buttons insertably mounted in a recess formed in a front side surface of a housing. A printed circuit board to which the control buttons are electrically connected is inserted in a recess formed in a rear side surface of the housing. Provided on the printed circuit board is a memory subsystem for holding a countdown time and at least one interim time, a processor subsystem for counting down, from the countdown time, time remaining in the on-going game of paintball until time expires and for determining first and second elimination counts, and an LCD display, electrically coupled to the processor subsystem, for displaying the time remaining in the on-going game of paintball, the first elimination count and the second elimination count. By selectively depressing the control buttons, the processor subsystem will start and stop the countdown of time remaining, record the time remaining in the memory subsystem as a flag time and increment or decrement the first and second elimination counts. By mounting the paintball game scorekeeper on a rear side surface of a bulk loader for holding paintballs, the paintball game scorekeeper forms part of a paintball game playing system which includes a paintball gun and the bulk loader and may be readily used by a participant in the on-going game of paintball without significantly disrupting the participant's ability to play.

22 Claims, 2 Drawing Sheets

LOADER MOUNTED PAINTBALL GAME SCOREKEEPER AND AN ASSOCIATED PAINTBALL GAME PLAYING SYSTEM

BACKGROUND OF THE INVENTION

1. Field of the Invention

The present invention generally relates to a paintball game playing system and, more particularly, relates to an electronic paintball game scorekeeper suitable for mounting on other types of paintball game playing equipment such as bulk loader devices.

2. Description of Related Art

The game of paintball has enjoyed great success in recent years. In the game, each one of two or more teams try to capture the opposing team's flag. The players on the teams each carry a $CO_2$-powered gun that shoots paintballs—gelatin covered spherical capsules which contain a colored liquid—a considerable distance. When a player is hit with a paintball fired from a gun, the paintball ruptures and leaves a colored "splat" on the hit player who is then "out" and must leave the game.

Depending on the size of the field and the number of players, paintball games usually have a time limit of between twenty and forty-five minutes. During this time period, each team tries to capture the opposing team's flag. Victory occurs when a player successfully carries the captured flag back to his or her team's flag station and hangs it. In order to develop proper strategy during the game, it is important for the team captain or other players to be able to monitor the progress of their, as well as the opposing, team. For example, it would be very useful for a player to know how much time remains in a game, as well as how many players on his or her, as well as on the opposing, team have been eliminated. With such information, the team captain would be able to develop better offensive and defensive strategies. Additionally, in order to properly score a paintball game, particularly during tournament play, it is necessary to record when a team grabs, as well as hangs, their opponent's flag as these times may be required to break a tie between two teams. Furthermore, in preparing a "box score" for a paintball game, both these times, as well as the elimination count for each team, are permanently recorded after the game is over.

However, the game of paintball does not lend itself particularly well to one or more players carrying the materials needed to record elimination counts and flag times. During a typical paintball game, players roam freely around a large playing field and frequently conceal themselves, for example, by hiding behind a tree or in thick brush, to avoid detection by the opposing team. Furthermore, players typically wear full head gear, as well as bulky clothing, to avoid injury if struck by a paintball and carry a paintball gun which requires both hands for proper operation, as well as various other supplies which may be needed during the game. Thus, the typical player is unable to readily carry or operate a conventional scorekeeping device without seriously detracting from his or her ability to fully participate in the game.

It may be readily seen from the foregoing that it would be desirable to provide a scorekeeper which may be readily used by a player during a paintball game to monitor playing time and record both flag times and elimination counts. It is, therefore, the object of the invention to provide such a scorekeeper for paintball games.

SUMMARY OF THE INVENTION

In one embodiment, the present invention is of a paintball game playing system which includes a paintball gun, a bulk loader for holding paintballs and a paintball game scorekeeper. The bulk loader is operatively connected to the paintball gun such that the paintball gun fires paintballs supplied thereto by the bulk loader. The paintball game scorekeeper is mounted on the bulk loader and maintains information regarding an on-going game of paintball. Preferably, the paintball game scorekeeper is mounted on a rear side surface of the bulk loader and is sized to have height and width dimensions less than the height and width of the rear side surface of the bulk loader.

In various aspects thereof, the paintball game scorekeeper may include one or more of the following: means for displaying a first elimination count, means for incrementing or decrementing the first elimination count, means for displaying a second elimination count, means for incrementing or decrementing the second elimination count, means for determining time remaining in a paintball game, means for displaying the time remaining in the paintball game and means for recording at least one interim time during the paintball game.

In another aspect thereof, the paintball game scorekeeper is comprised of a housing having front and rear side surfaces. A switch member having at least one control button is insertably mounted in a first recess formed in the front side surface of the housing. A printed circuit board to which the at least one control button is electrically connected thereto is inserted in a second recess formed in the rear side surface of the housing and is supported between an interior side surface of the housing and a first side surface of a cover member coupled to the housing. The printed circuit board including circuitry, controlled by the control buttons, for maintaining information regarding the on-going game of paintball.

In a preferred embodiment thereof, the circuitry is comprised of a memory subsystem for holding a countdown time and at least one interim time, a processor subsystem for counting down, from the countdown time, time remaining in the on-going game of paintball until time expires and for determining first and second elimination counts, and an LCD display, electrically coupled to the processor subsystem, for displaying the time remaining in the on-going game of paintball, the first elimination count and the second elimination count. The first control button starts and stops the count down of time remaining in the on-going game of paintball by the processor subsystem. The second control button causes the processor subsystem to record the time remaining in the on-going game of paintball in the memory subsystem as a flag time. The third and fourth control buttons cause the processor subsystem to respectively increment or decrement the first elimination count and the fifth and sixth control buttons cause the processor subsystem to respectively increment or decrement the second elimination count.

BRIEF DESCRIPTION OF THE DRAWING

The present invention may be better understood, and its numerous objects, features and advantages will become apparent to those skilled in the art by reference to the accompanying drawing, in which.

DETAILED DESCRIPTION

Figure 1:
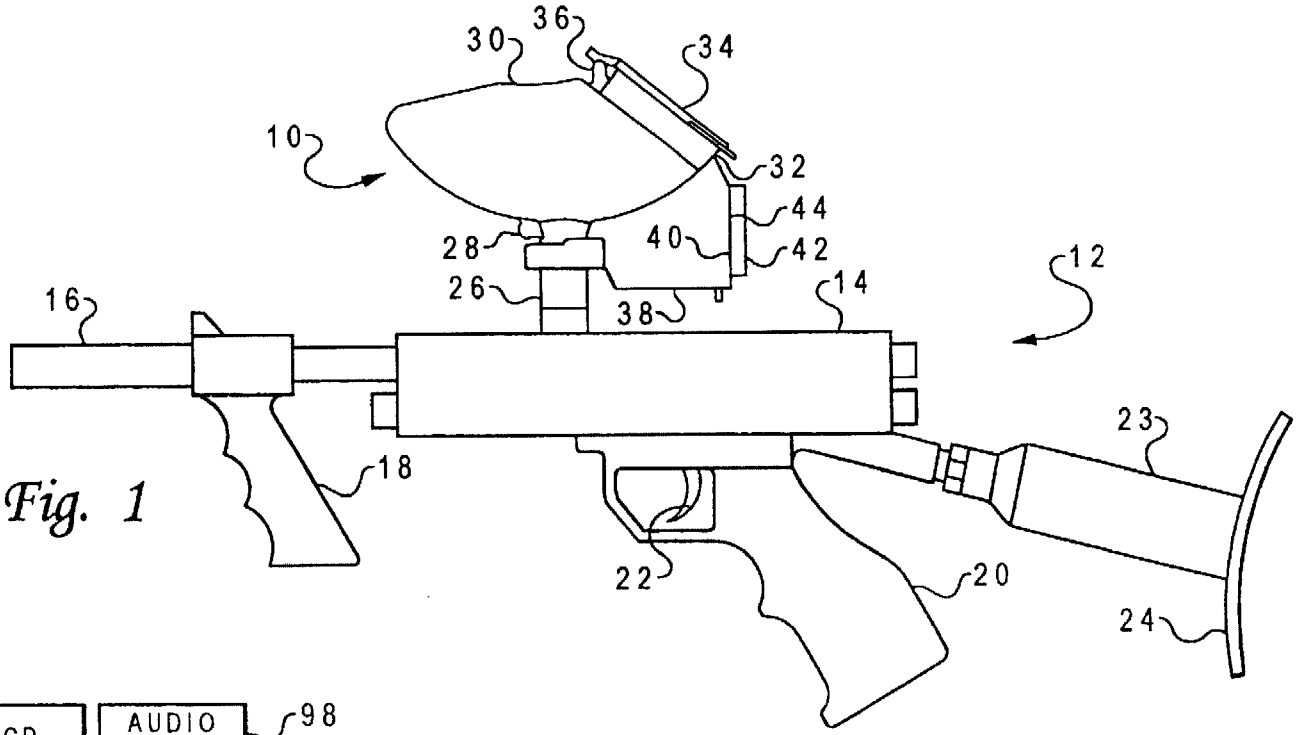
FIG. 1 is a side elevational view of a paintballs game playing system which includes a paintball gun, a bulk loader operatively attached to the paintball gun and a paintball game scorekeeper fixedly attached to the bulk loader.

Referring first to FIG. 1, a paintball game playing system which includes a paintball gun having a bulk loader to which a paintball game scorekeeper is mounted thereto may now be seen. Paintball gun 12 is representatively of the semi-automatic firing type and has a body portion 14, a barrel 16 with a front hand grip 18 generally downwardly depending therefrom, a central hand grip 20 having a trigger 22, and a rear stock portion which includes a $CO_2$ propellant gas canister 23 and a shoulder rest 24.

The paintball gun 12 is conventionally fitted with an in-feed tube 26 having an interior passageway extending therethrough. The inner or bottom end of the in-feed tube 26 communicates with a firing chamber (not shown) within the paintball gun 12. In turn, the firing chamber is in operative communication with the $CO_2$ canister 23. Paintballs stored within a bulk loader 10, mounted to an upper end of the in-feed tube 26 are gravity fed downwardly into the firing chamber for sequential firing from the paintball gun 12 by pressure bursts of $CO_2$ gas from the $CO_2$ canister 23 which are produced by sequential pulls of the trigger 22.

The bulk loader 10 includes an out-feed tube 28 and a main body portion 30 having an interior area in communication with an interior passageway of the out-feed tube 28. Paintballs are housed in the interior are of the bulk loader 10 until they are dropped, through the interior passageways of the out-feed tube 28 and the in-feed tube 26 into the firing chamber of the paintball gun 12. Mounted on a rear end 32 of the main body portion 30 of the bulk loader 10 is a generally transparent, disc-shaped cap 34 that provides viewing access into the interior area of the main body portion 30. The transparent cap 34 may also be pivoted around about a hinge structure 36 to allow access to the interior area of the main body portion 30. Paintballs to be stored in the interior are of the main body portion 30 are loaded through the, now open, rear end 32.

The bulk loader 10 further includes a lower body portion 38 which projects downwardly from, and is integrally formed therewith, the main body portion 30. The lower body portion 38, which, for example, may be used to house a power supply and stepper motor for driving an agitator for breaking paintball jams within the bulk loader 10 in a manner described in greater detail in our prior U.S. Pat. No. 5,282,454. The lower body portion 38 has a generally flat rear side surface 40 on which a paintball game scorekeeper 42 is fixedly attached thereto by adhesion means, for example, a strip of fastening tape 97 mounted on a back side surface 44 of the paintball game scorekeeper 42 (see FIG. 2). In the embodiment of the invention disclosed herein, the paintball game scorekeeper 42 is illustrated as being mounted on the rear side surface 40 of the lower body portion 38 of the bulk loader 10. By placing the paintball game scorekeeper 42 in this particular location, the device may be readily operated without proving disruptive to the play of the operator. It is specifically contemplated, however, that, in alternate embodiments of the invention, the paintball game scorekeeper 42 may be mounted on suitable surfaces of other types of paintball game equipment.

Figure 2:
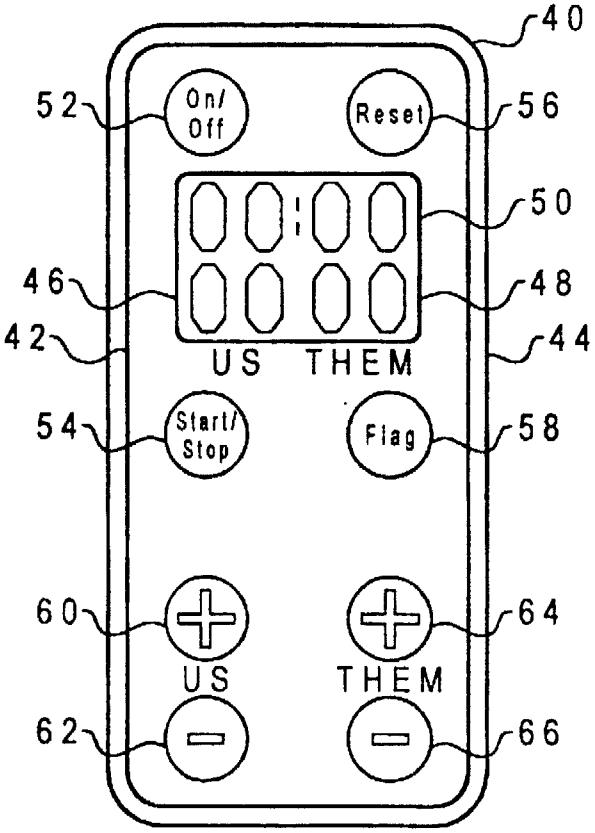
FIG. 2 is a front view of the paintball game scorekeeper mounted on the bulk loader of FIG. 1 and constructed in accordance with the teachings of the present invention.

Referring next to FIG. 2, a front view of the paintball game scorekeeper 42 mounted on the rear side surface 44 of the lower body portion 38 of the bulk loader 10 may now be seen. Preferably, the paintball game scorekeeper should be dimensioned to fit on the rear side surface 44 without having any portion thereof laterally project from the rear side surface 44. It has been discovered that a paintball scorekeeper dimensioned to have a height of about 2.25 inches and a width of about 1.05 inches will prove suitable for the uses contemplated herein. Dimensioning the paintball game scorekeeper 42 such that it will laterally project from the rear side surface 44 is highly undesirable since such a scorekeeper would be prone to being inadvertently knocked off the bulk loader 10 during play. It is further preferred that the thickness of the paintball game scorekeeper 42 be kept at the minimum thickness consistent with its configuration as set forth below. Again, by minimizing the thickness of the paintball game scorekeeper 42, the scorekeeper will be less likely to be inadvertently knocked off the bulk loader 10 during play. The paintball game scorekeeper 42 includes a liquid crystal diode (or "LCD") display 46 for providing real-time information regarding the status of an on-going paintball game. The LCD display 46 includes four-digit lower and upper display rows 48 and 50. The leftmost two digits of the lower row 48 is used to display an "US" elimination count, i.e. the number of players on the team on which the operator of the paintball game scorekeeper 42 is playing which have been eliminated from further play while the rightmost two digits of the lower row 48 is used to display a "THEM" elimination count, i.e. the number of players on the opposing team which have been eliminated from further play. Of course, the US and THEM elimination counts are separated by a small space so that the operator may readily discern the elimination counts for the two teams. The upper row 50 of the LCD display 46 is used to display the time remaining in the on-going game in minutes and seconds.

The paintball game scorekeeper further includes first, second, third, fourth, fifth, sixth, seventh and eighth control buttons 52, 54, 56, 58, 60, 62, 64 and 66 which, as more fully described below, are used to operate the paintball game scorekeeper 42. The first control button 52 is an ON/OFF button which, when depressed, will alternately power-up or power-down the paintball game scorekeeper 42. The second control button 54 is a start/stop button which, when depressed, will alternately start or stop the countdown of time remaining in the paintball game. The third control button 56 is a reset button which, when the countdown of time remaining is stopped, resets the time remaining in the paintball game to a value held in memory and resets the US and THEM elimination count to zero. The fourth control button 58 is a flag button which, when depressed while the countdown of time remaining is continuing, stores the amount of time remaining at the time when the flag button was depressed in memory as an interim time while allowing the countdown of time remaining to continue to run. By depressing the fifth control button 60, the US elimination count is incremented by one. Conversely, by depressing the sixth control button 62, the US elimination count is decremented by one. Similarly, the THEM elimination count can be incremented or decremented, by respectively depressing the seventh or eighth control button 64 or 66.

Figure 3:
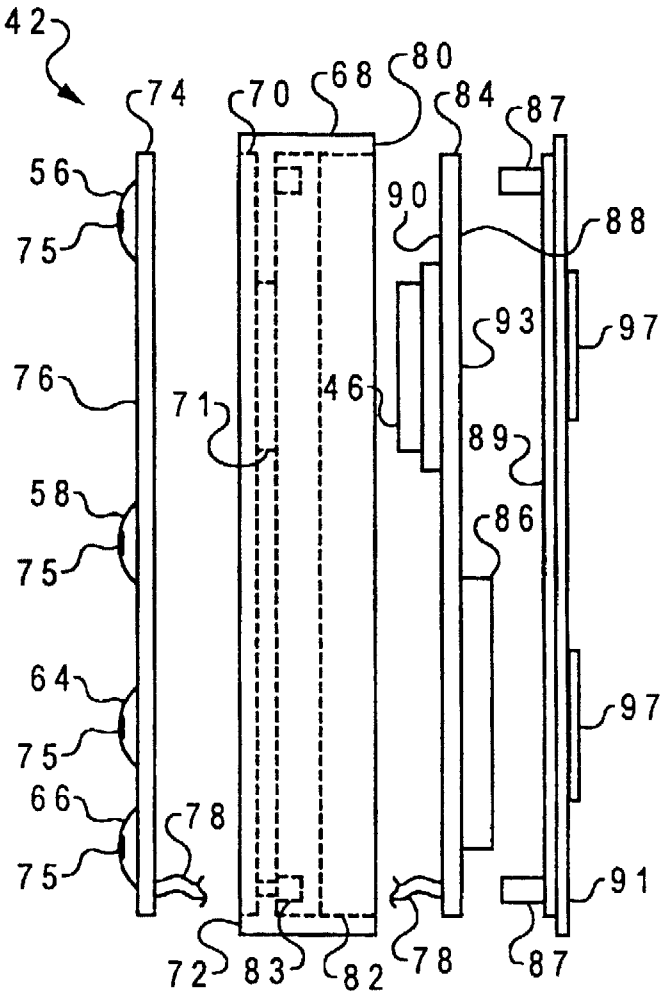
FIG. 3 is an exploded side view of the paintball game scorekeeper of FIG. 2.

Referring next to FIG. 3 an exploded side view of the paintball game scorekeeper 42 may now be seen. The paintball game scorekeeper 42 includes a plastic housing having a recess 70 in a top side surface 72 thereof. Receivably mounted in the recess 70 is a switch member 74, preferably in a water-tight engagement, in which the first through eighth control buttons 52 through 66 are incorporated. The switch member 74 includes a series of electrical traces (not shown), one for each of the first through eighth control buttons 52 through 66 incorporated therein, formed on a front side surface 76 thereof. Each of the electrical traces is connected to a voltage source on one end, to a printed circuit board 84 on the other end and includes a break over which a domed portion of the correspond control button extends. For example, in FIG. 3, domed portions 56*a*, 58*a*, 64*a* and 66*a* of the third, fourth, seventh and eighth control buttons 56, 58, 64 and 66 may be seen. Formed on the inner side surface of each of the control buttons 52 through 66 is an electrical contact 75, which when the domed portion of a selected control button is depressed, closes the break in the corresponding electrical trace, thereby allowing passage of an electrical signal indicating that the control button has been depressed to the printed circuit board 84. The operation of the control buttons 52 through 66 and associated electrical traces to transmit an electrical signal indicating depression thereof is conventional and is not considered to require any further description. Of course, the switch member 74 should have a layer (not shown) of a relatively thin, transparent insulative material which extends over both the front side surface 76 of the switch member 74 and the domed portions of the first through eighth control buttons 52 through 66.

The housing 68 further includes a second recess 82, formed in a lower side surface 80 of the housing 68, for receiving a printed circuit board 84 therein. As will be more fully described below, the printed circuit board 84 has an electronic circuit formed thereon which provides the timing and scorekeeping functions herein described. The printed circuit board 84 is supported within the second recess 82 by standoffs 83 which downwardly project from an interior side surface 85 and standoffs 87 which upwardly project from an upper side surface 89 of bottom cover member 91. Power is supplied to the printed circuit board 84 by a battery 86, preferably a three volt lithium battery, removably mounted on a bottom side surface 93 of the printed circuit board 84. In addition to supporting the printed circuit board 84, the standoffs 87 define a space between the bottom cover member 91 and the printed circuit board 84 for the battery 86. Preferably, the bottom cover member 91 is provided with an openable door (not shown) to provide access to the battery 86. The battery 86 is connected to the various electronic components residing on a top side surface 90 of the printed circuit board 84 by conventional electrical interconnection means (not shown) to provide power thereto. Also residing on the top side surface of the printed circuit board 84 is the LCD display 46 which, when the printed circuit board 84 is supportably mounted within the housing 68, projects through an aperture 71 in the housing 68 such that the LCD display 46 is visible through the transparent layer of insulative material which covers the switch member 74.

Electrical signals indicating selective depression of the first through eighth control buttons 52 through 66 are provided to the printed circuit board 84 via a wire harness 78 which includes a series of wires, each of which is coupled to one of the electrical traces formed on the top side surface of the switch member 74, which extends from the switch member 74, through an interior passageway 95 formed in the housing 68, and to the printed circuit board 84. The wire harness 78 may also include one or more wires which provide power to the electrical traces such that, when the control buttons 52–66 are depressed, an electrical signal is transmitted by the corresponding electrical trace.

Figure 4:
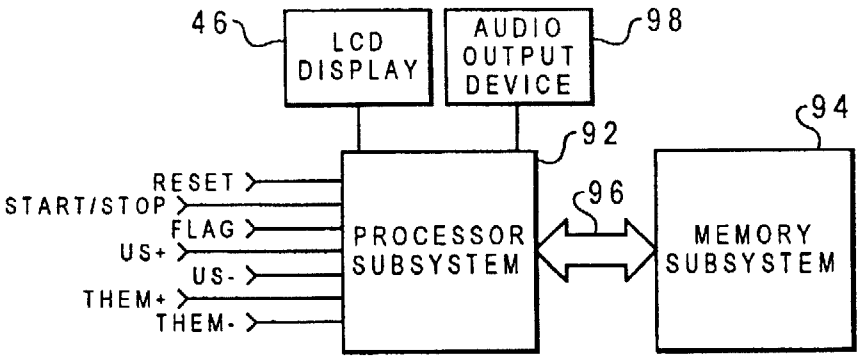
FIG. 4 is a simplified block diagram of the electronics portion of the paintball game scorekeeper of FIGS. 2–3.

Referring next to FIG. 4, the electronic circuitry residing on the top side surface 90 of the printed circuit board 84 will now be described in greater detail. As may now be seen, the paintball game scorekeeper 42 includes a processor subsystem 92 and a memory subsystem 94 coupled together by a bus 96 for bi-directional exchanges of address, data and control signals. The processor subsystem 92 includes start/stop, reset, flag, US+, US−, THEM+ and THEM− input lines which may be respectively asserted by depressing the second control button 54, the third control button 56, the fourth control button 58, the fifth control button 60, the sixth control button 62, the seventh control button 64 and the eighth control button 66, respectively. Of course, the remaining electrical connection between the first (or ON/OFF) control button 52, the circuitry provided on the printed circuit board 84 and the battery 86 is conventionally configured and is not, therefore, included in the foregoing description. Preferably, the processor subsystem 92 includes a countdown timer circuit which maintains a countdown time and a counter circuit which maintains US and THEM elimination counts. The memory subsystem 94 is configured to hold five time values—a countdown start time and as many as four flag times—and two counts—an US elimination count and a THEM elimination count—therein.

Operation of the paintball game scorekeeper 42 is as follows. From a powered-down state, the paintball game scorekeeper 42 is powered-up by depressing the first control button 52. Once powered-up, the second control button 54 and the fourth control button 58 may be simultaneously depressed to switch the processor subsystem 92 into reset mode whereby a countdown start time may be read into the memory subsystem 94. More specifically, upon simultaneous depression of the second and fourth control buttons 54 and 58, the countdown start time will be retrieved from the memory subsystem 94 and repeatedly flashed in the upper row 50 of the LCD display 46. The countdown start time displayed in the upper row 50 of the LCD display 46 may be incremented or decremented by one minute by respectively depressing the fifth or seventh control buttons 60 or 62 or incremented or decremented by one second by respectively depressing the sixth or eighth control buttons 64 or 66. Once the desired value for the countdown start time is displayed in the upper row 50, the displayed time may be stored into the memory subsystem 94 as the countdown start time by depressing the reset button 56.

Once a countdown start time has been stored in the memory subsystem 94, the paintball game scorekeeper 42 is ready for use. To begin use of the paintball game scorekeeper 42, the third control button 56 is depressed a single time to assert the reset line. In response to an assertion of the reset line, the processor subsystem 92 retrieves the countdown start time from the memory subsystem 94 for later use, displays the retrieved countdown start time in the upper row 50 of the LCD display 46, resets the US and THEM elimination counts stored in the memory subsystem 94 to zero and displays the reset US and THEM elimination counts in the lower row 48 of the LCD display 46. Then, when the game is ready to commence, the player depresses the second control button 54 a single time, thereby asserting the start/stop line. In response to the assertion of the start/stop line while the countdown timer circuit is not performing a countdown, the processor subsystem 92 issues a signal to the audio output device 98 residing on the printed circuit board 84 which causes the audio output device 98 to emit a first audible signal, preferably, a single beep. The processor subsystem 92 also instructs the countdown timer circuit to begin a countdown from the previously retrieved countdown start time to zero and to display the countdown time, i.e., the time remaining in the on-going paintball game, in the upper row 50 of the LCD display 46.

The countdown time may be temporarily stopped, for example, for a time out or other delay of game, by depressing the second control button 54, thereby asserting the start/stop line. In response to the assertion of the start/stop line while the countdown timer circuit is performing a countdown, the processor subsystem 92 issues a signal to the audio output device 98 to again emit the first audible signal, stops the countdown timer circuit and temporarily holds the count of time remaining in the paintball game. The countdown time may later be restarted, again by depressing the second control button 54 to assert the start/stop line.

As the game proceeds, a player or players on either team may be "tagged", i.e., struck by a paintball and eliminated from the game. When the player carrying the paintball game scorekeeper 42 on his or her bulk loader 10 learns of an elimination, for example, from an oral report by a teammate, the player increases the elimination count for his or the opponent's team by respectively depressing the fifth or seventh control buttons 60 or 64 a single time for each player eliminated, thereby asserting the US+ or THEM+ lines. Each time the processor subsystem 92 detects the assertion of the US+ or THEM+ lines, the processor subsystem 92 will cause the counter circuit to add one to the respective US and THEM elimination counts held in the memory subsystem 94 and replace the US and THEM elimination counts displayed in the lower row 48 of the LCD display 46 with the updated values. Similarly, elimination counts will be decremented, for example, if a prior report of an elimination was erroneous, by respectively depressing the sixth or eighth control button 62 or 66 to assert the US− or THEM− lines. As before, in response to the assertion of the US− or THEM− lines, the processor subsystem 92 will decrement the US or THEM elimination count held in the memory subsystem by one and replace the US and THEM elimination counts displayed in the lower row 48 of the LCD display 46 with the updated values.

In the event that a player "grabs" the flag of the opposing team, the player carrying the paintball game scorekeeper 42 on his or her bulk loader 10 will depress the fourth control button 58 to assert the flag line. In response to the assertion of the flag line while the countdown timer circuit is performing a countdown, the processor subsystem 92 will store the countdown time in the memory subsystem 94 as a first flag time. Succeeding depressions of the fourth control button 58 while the countdown timer circuit is performing a countdown will cause the processor subsystem 92 to store the countdown time in the memory subsystem 94 as a second, third or fourth flag times before overwriting the first flag time. For example, the player carrying the paintball game scorekeeper 42 may record, as the second, third and fourth flag times, the time when the player making the first grab was eliminated, the time when a second grab of the opposing team's flag occurred and the time when the opposing team's flag was hung.

The paintball game ends when the countdown time has decremented to zero. When the countdown time reaches zero, the processor subsystem 92 turns the countdown timer circuit off and issues a signal to the audio output device 98 which causes the audio output device 98 to emit a second audible signal, preferably, a series of beeps, to indicate the end of the paintball game. The player carrying the paintball game scorekeeper 42 may now record the US and THEM elimination counts displayed in the lower row 48 of the LCD display 46. To review recorded flag times, the player depresses the fourth control button 58 to assert the flag line. Upon assertion of the flag line when the countdown timer circuit is off, the processor subsystem will retrieve the first flag time stored in the memory subsystem 94. Succeeding depressions of the fourth control button 58 while the countdown timer circuit is off will cause the processor subsystem 92 to retrieve succeeding flag times stored in the memory subsystem 94.

Thus, there has been described and illustrated herein, a paintball game scorekeeper uniquely configured such that it may be mounted on a rear side surface of a bulk loader, thereby enabling a player to readily monitor the time remaining in a game, as well as record flag times and elimination counts. However, those skilled in the art will recognize that many modifications and variations besides those specifically mentioned herein may be made without departing substantially from the concept of the present invention. Accordingly, it should be clearly understood that the form of the invention described herein is exemplary only and is not intended as a limitation on the scope of the invention.

What is claimed is:

1. A paintball game playing system, comprising:

a paintball gun;

a bulk loader for holding a plurality of paintballs, said bulk loader operatively connected to said paintball gun, said paintball gun firing paintballs supplied thereto by said bulk loader; and a paintball game scorekeeper mounted on said bulk loader, said paintball game scorekeeper maintaining information regarding an on-going game of paintball.

2. A paintball game playing system according to claim 1 wherein said bulk loader further comprises a rear side surface, said paintball game scorekeeper mounted on said rear side surface of said bulk loader.

3. A paintball game playing system according to claim 2 wherein said paintball game scorekeeper has a height less than a height of said rear side surface of said bulk loader.

4. A paintball game playing system according to claim 3 wherein said paintball game scorekeeper has a width less than a width of said rear side surface of said bulk loader.

5. A paintball game playing system according to claim 1 wherein said paintball game scorekeeper further comprises:

means for displaying a first elimination count;

means for incrementing or decrementing said first elimination count.

6. A paintball game playing system according to claim 5 wherein said paintball game scorekeeper further comprises:

means for displaying a second elimination count; and means for incrementing or decrementing said second elimination count.

7. A paintball game playing system according to claim 1 and wherein said paintball game scorekeeper further comprises:

means for determining time remaining in a paintball game; and means for displaying said time remaining in said paintball game.

8. A paintball game playing system according to claim 7 wherein said paintball game scorekeeper further comprises means for recording at least one interim time during said paintball game.

9. A paintball game playing system according to claim 1 wherein said paintball game scorekeeper further comprises:

a housing having a front side surface, a first recess formed in said front side surface, a rear side surface and a second recess formed in said rear side surface;

a switch member insertably mounted in said first recess, said switch member having at least one control button formed thereon;

a printed circuit board, said printed circuit board inserted in an aperture defined by said second recess;

a cover member coupled to said housing, said printed circuit board supported in said aperture by interior surfaces of said housing and said cover member;

said printed circuit board including circuitry for maintaining information regarding an on-going game of paintball;

said at least one control button electrically coupled to, and controlling operation of, said circuitry on said printed circuit board.

10. A paintball game playing system according to claim 9 wherein said circuitry further comprises:

a memory subsystem for holding a countdown time; and a processor subsystem for counting down, from said countdown, time remaining in said on-going game in said on-going game of paintball until time expires.

11. A paintball game playing system according to claim 10 wherein said at least one control button includes a first control button for starting and stopping said count down of time remaining in said on-going game of paintball by said processor subsystem.

12. A paintball game playing system according to claim 11 and further comprising:

an LCD display, electrically coupled to said processor subsystem, for displaying said time remaining in said on-going game of paintball;

said LCD display mounted on said printed circuit board and projecting through an aperture in said switch member.

13. A paintball game playing system according to claim 12 wherein said memory subsystem is configured to maintain at least one flag time and wherein said at least one control button includes a second control button for causing said processor subsystem to record said time remaining in said on-going game of paintball in said memory subsystem as a flag time.

14. A paintball game playing system according to claim 13 wherein said processor subsystem further comprises means for determining a first elimination count and wherein said at least one control button includes third and fourth control buttons for causing said processor subsystem to respectively increment or decrement said first elimination count.

15. A paintball game playing system according to claim 14 wherein said processor subsystem further comprises means for determining a second elimination count and wherein said at least one control button includes fifth and sixth control buttons for causing said processor subsystem to respectively increment or decrement said second elimination count.

16. A paintball game playing system according to claim 15 wherein said LCD display also displays said first and second elimination counts.

17. A paintball game scorekeeper, comprising:

means for displaying a first elimination count;

means for incrementing or decrementing said first elimination count;

means for determining time remaining in a paintball game;

means for displaying said time remaining in said paintball game; and means for recording at least one interim time during said paintball game while a countdown of said time remaining in said paintball game is on-going.

18. A paintball game scorekeeper according to claim 17 and further comprising:

means for displaying a second elimination count;

means for incrementing or decrementing said second elimination count.

19. A paintball scorekeeper, comprising:

a housing having a front side surface, a first recess formed in said front side surface, a first interior side surface exposed by said first recess, a rear side surface, a second recess formed in said rear side surface, a second interior side surface exposed by said second recess, an interior passageway extending between said first interior side surface and said second interior side surface and at least one standoff projecting from said second interior side surface;

a switch member insertably mounted in said first recess in a watertight seal and engaging said first interior side surface, said switch member having first, second, third, fourth, fifth, and sixth control buttons formed thereon;

a printed circuit board, said printed circuit board inserted in second recess, each of said first, second, third, fourth, fifth and sixth control buttons electrically connected to said printed circuit board by an electrical lead which extends through said interior passageway;

a cover member coupled to said housing and having a first side surface with at least one standoff projecting therefrom, said printed circuit board supported in said second recess by at least one standoff projecting from said second interior side surface of said housing and said at least one standoff projecting from said first side of said cover member;

said printed circuit board including;

a memory subsystem for holding a countdown time and at least one interim time; and a processor subsystem for counting down, from said countdown time, time remaining in said on-going game of paintball until time expires and for determining first and second elimination counts; and an LCD display, electrically coupled to said processor subsystem, for displaying said time remaining in said on-going game of paintball, said first elimination count and said second elimination count;

said LCD display mounted on said printed circuit board and projecting through an aperture in said switch member;

said first control button starting and stopping said count down of time remaining in said on-going game of paintball by said processor subsystem;

said second control button causing said processor subsystem to record said time remaining in said on-going game of paintball in said memory subsystem as a flag time;

said third and fourth control buttons causing said processor subsystem to respectively increment or decrement said first elimination count;

said fifth and sixth control buttons causing said processor subsystem to respectively increment or decrement said second elimination count.

20. A paintball game scorekeeper, comprising:

a housing having a front side surface, a first recess formed in said front side surface, a first interior side surface exposed by said first recess, a rear side surface, a second recess formed in said rear side surface, a second interior side surface exposed by said second recess, an interior passageway extending between said first interior side surface and said second interior side surface;

a switch member insertably mounted in said first recess and engaging said first interior side surface, said switch member having at least one control button formed thereon;

a printed circuit board, said printed circuit board inserted in said second recess, each of said at least one control button electrically connected to said printed circuit board by an electrical lead which extends through said interior passageway;

a cover member coupled to said housing and having a first side surface, said first side surface of said cover member and said second interior side surface of said housing supportably mounting said printed circuit board in said second recess;

said printed circuit board including:

a memory subsystem;

a processor subsystem electrically coupled to said memory subsystem;

a display electrically coupled to said processor subsystem;

said display mounted on said printed circuit board and projecting through an aperture in said switch member; and said at least one control button controlling operation of said processor subsystem.

21. A paintball game scorekeeper according to claim 20 wherein at least one standoff projects from second interior side surface of said housing and at least one standoff projects from said first side surface of said cover member, said printed circuit board supported in said recess by said at least one standoff projecting from said second interior side surface of said housing and said at least one standoff projecting from said first side surface of said cover member.

22. A paintball game scorekeeping system, comprising:

a loader for holding a plurality of paintballs, said bulk loader having a rear side surface; and a paintball game scorekeeper mounted on said rear side surface of said loader, said paintball game scorekeeper maintaining information regarding an on-going game of paintball;

wherein, when said loader is operably connected to a paintball gun, said paintball game scorekeeper is operable by a player while said paintball game is on-going.

* * * * *

UNITED STATES PATENT AND TRADEMARK OFFICE

Certificate

Patent No. 5,736,720 Patented: April 7, 1998

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Robert L. Bell, David W. Bell and Lamar L. Lopez.

Signed and Sealed this Sixth Day of April, 1999.

BRIAN W. BROWN
*Special Programs Examiner*
Technology Center 2800